United States Patent [19]

Rudolph et al.

[11] Patent Number: 5,069,077

[45] Date of Patent: Dec. 3, 1991

[54] ACTUATING MECHANISM FOR A VACUUM-TYPE INTERRUPTER WITH A CONTACT SPRING

[75] Inventors: Dietrich Rudolph; Norbert Steinemer, both of Berlin, Fed. Rep. of Germany

[73] Assignee: Siemens Aktiengesellschaft, Berlin & Munich, Fed. Rep. of Germany

[21] Appl. No.: 521,373

[22] Filed: May 10, 1990

[30] Foreign Application Priority Data

May 11, 1989 [DE] Fed. Rep. of Germany ..... 3915522

[51] Int. Cl.[5] ..... H01H 33/66; H01H 3/46

[52] U.S. Cl. ..... 74/102; 74/105; 74/522; 200/335

[58] Field of Search ..... 74/519, 522, 102, 105; 200/335, 337, 342, 148 F

[56] References Cited

U.S. PATENT DOCUMENTS

| | | | |
|---|---|---|---|
| 376,752 | 1/1888 | Paterson | 74/102 |
| 2,525,470 | 10/1950 | Baker et al. | 200/148 F |
| 3,062,934 | 11/1962 | Nijland | 200/337 X |
| 3,845,263 | 10/1974 | Dickinson | 200/153 SC |
| 4,247,745 | 1/1981 | Wilson | 200/144 B |

FOREIGN PATENT DOCUMENTS

| | | | |
|---|---|---|---|
| 0060054 | 2/1982 | European Pat. Off. . | |
| 0136253 | 1/1987 | European Pat. Off. . | |
| 0159960 | 1/1987 | European Pat. Off. . | |
| 817173 | 8/1951 | Fed. Rep. of Germany . | |
| 1020531 | 12/1957 | Fed. Rep. of Germany | 74/519 |
| 1227110 | 10/1966 | Fed. Rep. of Germany . | |
| 2149437 | 9/1974 | Fed. Rep. of Germany . | |
| 1640230 | 8/1975 | Fed. Rep. of Germany . | |
| 2405149 | 8/1975 | Fed. Rep. of Germany . | |
| 1965810 | 6/1978 | Fed. Rep. of Germany . | |
| 2740156 | 3/1979 | Fed. Rep. of Germany . | |
| 808727 | 5/1981 | Fed. Rep. of Germany . | |
| 2118907 | 11/1983 | Fed. Rep. of Germany . | |
| 3841592 | 6/1989 | Fed. Rep. of Germany . | |

OTHER PUBLICATIONS

Milo, Jr., "Overriding Spring Mechanisms for Low--Torque Drivers", *Mechanisms, Linkages, and Mechanical Controls,* 1965, pp. 208–209.

*Primary Examiner*—Leslie A. Braun
*Assistant Examiner*—Scott Anchell
*Attorney, Agent, or Firm*—Kenyon & Kenyon

[57] ABSTRACT

An actuating mechanism for a vacuum-type interrupter with a contact spring. The actuating mechanism of a vacuum-type interrupter has a pivotally positioned two-armed lever and a spring which holds the contact force ready and which engages with the lever. The two-armed lever is guided with limited displacement in a bearing in a direction which runs approximately parallel to the actuation direction of the interrupter. While enabling, the two-armed lever pivots about a bearing bolt around the end of the bolt guiding until the contact elements engage each other. The further pivoting of the lever takes place around a linkage assembly between the two-armed lever and the actuating impact rod. The two-armed lever can be formed from two parallel split levers with a clearance such that the spring can engage between the split levers. The actuating mechanism is suitable for one or multiple vacuum circuit breakers, e.g., for use in gas insulated switchgear.

6 Claims, 4 Drawing Sheets

ACTUATING MECHANISM FOR A VACUUM-TYPE INTERRUPTER WITH A CONTACT SPRING'

BACKGROUND OF THE INVENTION

The invention relates to an actuating mechanism for switching on and off a vacuum-type interrupter with a pivotally positioned, two-armed lever which transmits a propulsive force and a spring which holds the contact force ready and which engages with the lever.

An actuating mechanism of this type has become known through EP-B-0 159 960.

The invention is based on the task of providing an actuating mechanism which comprises the least possible parts, which, however, in contrast to the known actuating mechanism, is suited above all to the actuating process by means of a propulsive force which is exerted approximately parallel to the longitudinal axis of the vacuum-type interrupter, and which can be designed in a simple manner by using spring tension of varying strengths.

SUMMARY OF THE INVENTION

According to the invention, it is provided that the spring is supported with its one end on a stationary abutment and that the lever is guided with limited displacement in its bearing in a direction which runs approximately parallel to the actuation direction of the interrupter. The bearing, which can be practically designed as a slotted hole, permits a pivotal movement of the lever around its flexible joint with the actuating impact rod of the interrupter. This process occurs, while enabling, when the two-armed lever is pivoted until it touches the contact elements and then is disengaged from the bearing by means of the propulsive force acting against the force of the contact spring, and is moved within the guideway. While disabling, the lever first is pivoted in its bearing until the contact elements come into contact with each other and the aforesaid movements occur.

An important characteristic of the actuating mechanism according to the invention consists in that it can be adapted to various paths and forces within further limits. In the case of an advantageous specific embodiment of the invention, the introduction of the propulsive force can take place at the one end region of the lever and the coupling of the movable impacting rod of the vacuum-type interrupter at the other end region of the lever, while the spring engages between the pivot bearing and the end region on the actuating side of the two-armed lever. In the case of another specific embodiment, the spring is engagingly mounted on the one end region of the lever and the pivot bearing of the lever is located between the point of engagement of the spring and the pivot of the movable impacting rod of the interrupter on the lever. In the case of both specific embodiments, variable lever lengths result for the purpose of translating from the contact spring to the contact elements.

A swing-free engagement of the actuating and propulsive forces can be achieved in that the two-armed lever is formed from two bars which are mounted parallel to each other, whose clearance corresponds at least to the diameter of the spring. The spring can then, for example, be secured onto a pin or bolt which penetrates the bars, i.e. the split lever.

The possibility also exists of varying the spring tension by mounting two or more springs in parallel, independently from the principal configuration of the bearing and the points of contact for external propulsive force, spring tension and impacting rods of the interrupters. For this purpose, the lever and the spring can be positioned or mounted in a stationary, reinforced frame whose side walls are arranged away from the bars of the lever by at least the diameter of the spring. In this manner, one spring or, in addition, also the spring of the basic configuration can be provided respectively within the spaces between the side walls of the frame and the bars of the lever, e.g., instead of the one spring which is located between the bars of the lever. In this manner, three different forces are available, regardless of the designated type of spring.

A bolt which penetrates the lever, i.e., its parallel bars and a bolt which is parallel to this and is supported within the side walls of the frame can be provided with notches to secure the position of the alternatively provided springs. In this manner it is ensured that the spring tensions engage symmetrically with the lever.

BRIEF DESCRIPTION OF THE DRAWINGS

The invention is more closely explained in the following in light of the figures, wherein.

Figure 3:
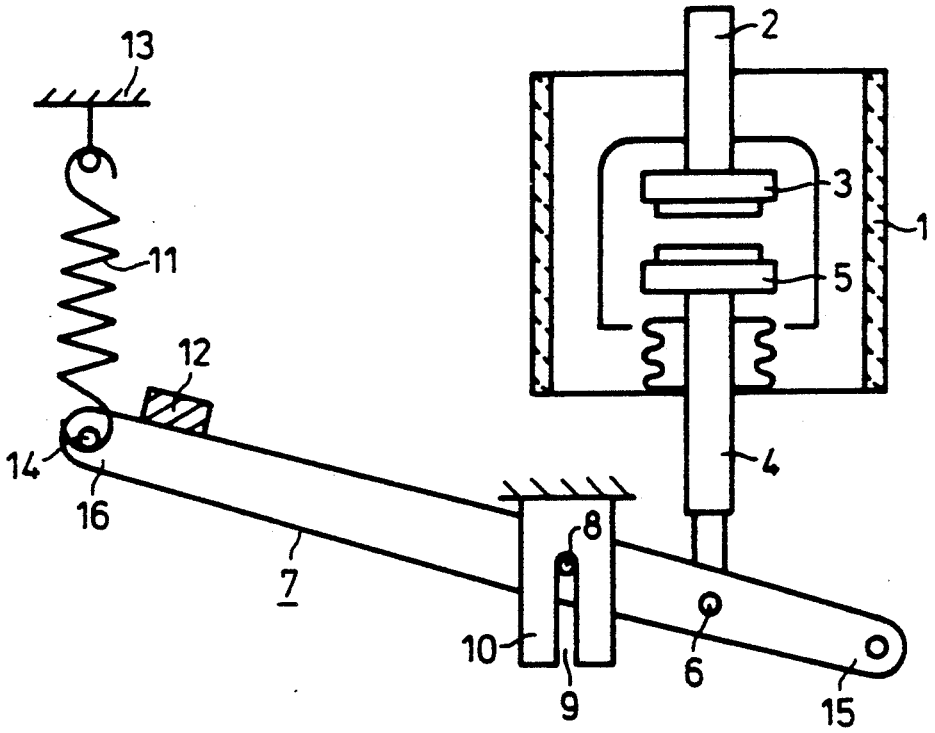
Figure 4:
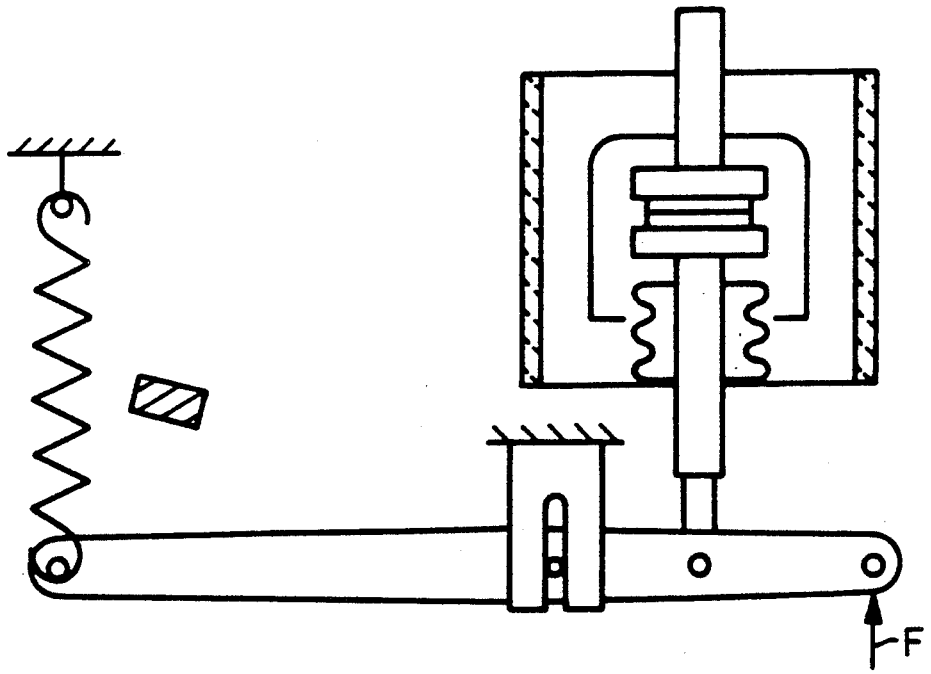

Another principal specific embodiment is also illustrated in two switching positions in FIGS. 3 and 4.

Figure 1:
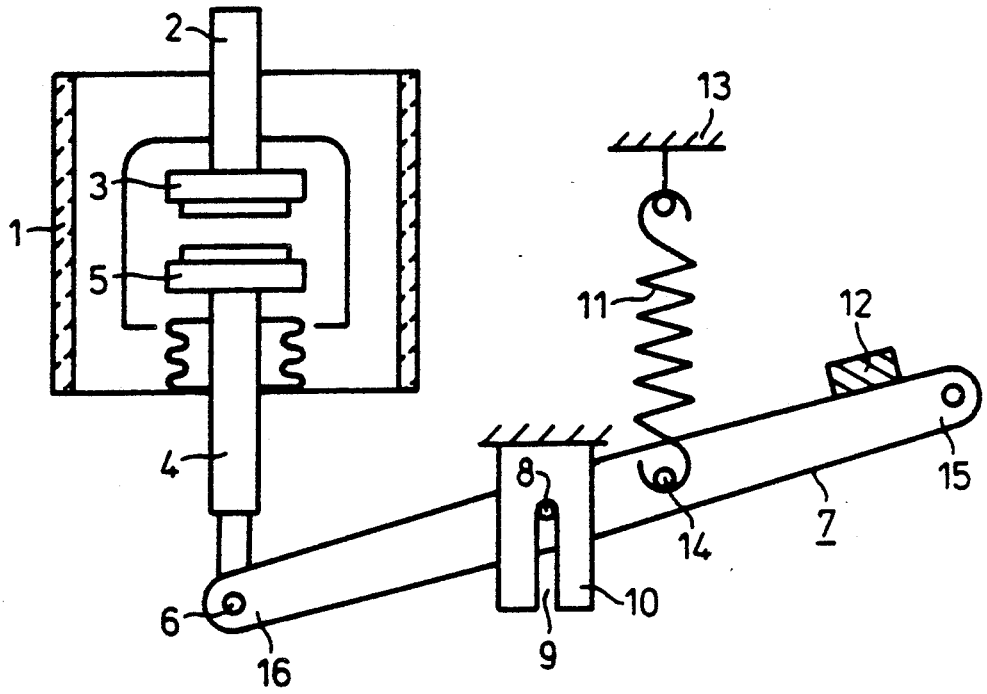
FIGS. 1 and 2 show schematically a principal specific embodiment of the invention. In this connection, a vacuum-type interrupter is shown with open contact elements in FIG. 1 and with closed contact elements in FIG. 2.
Figure 2:
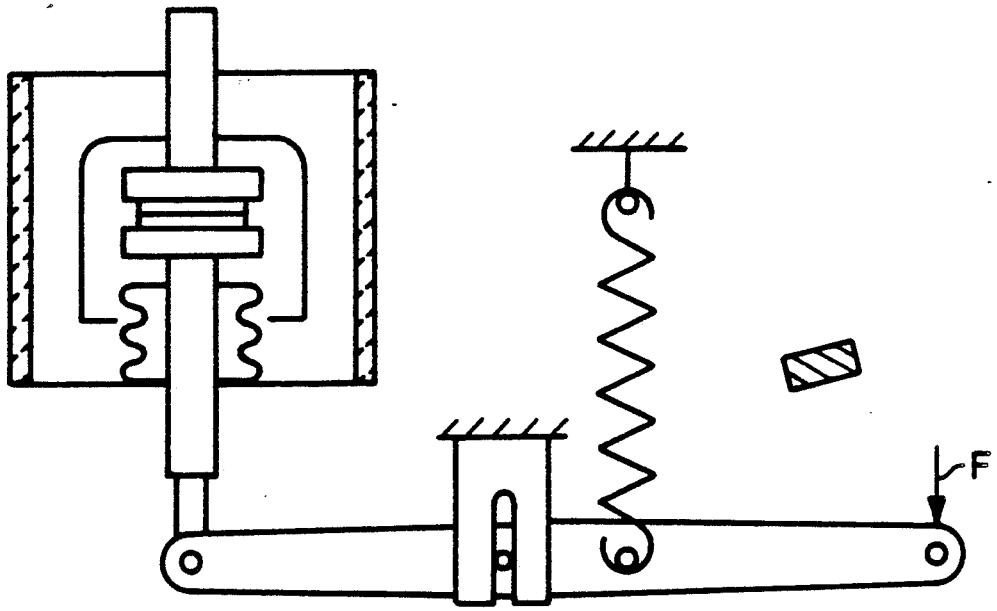
Figure 5:
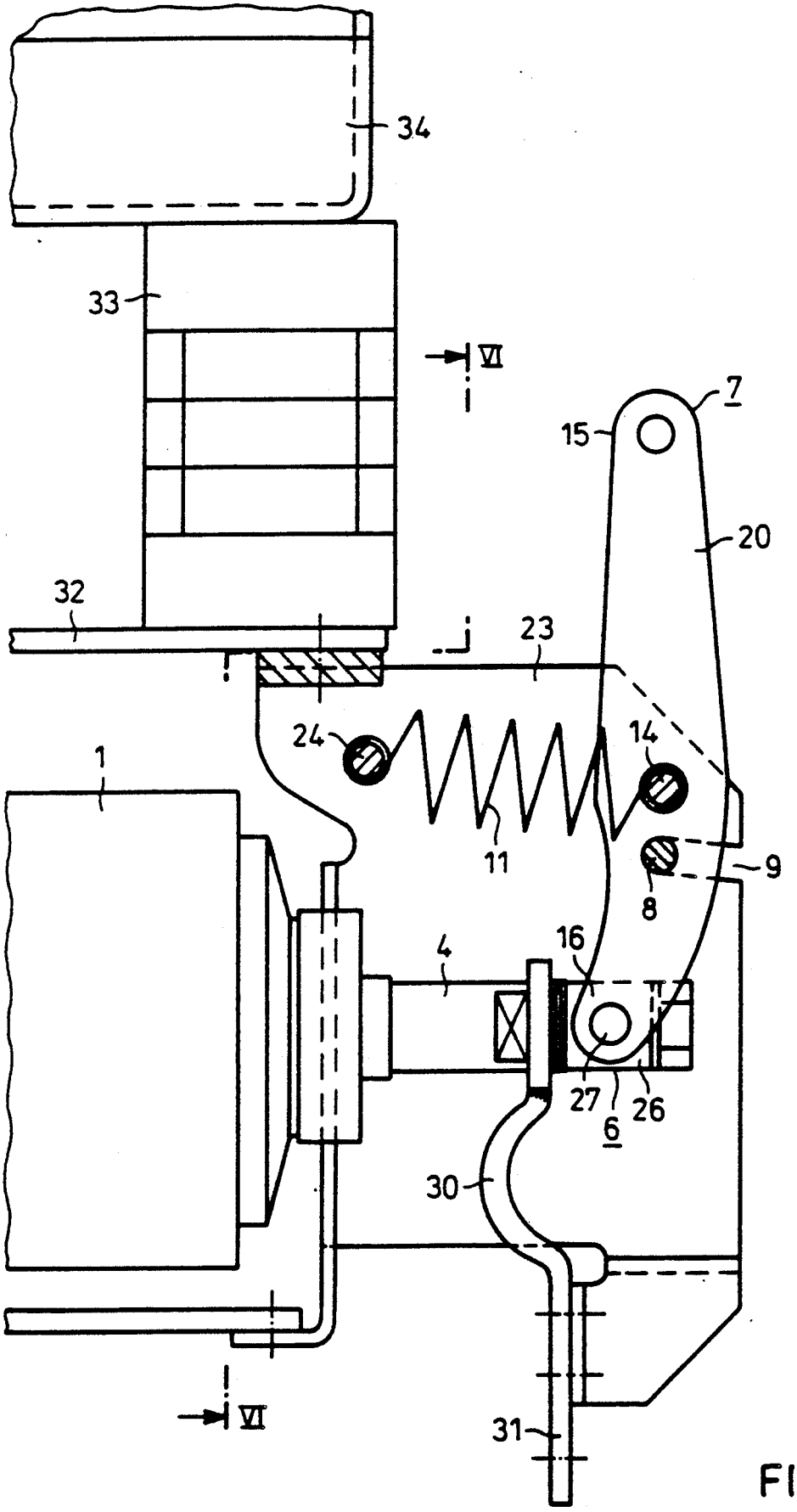

FIG. 5 shows a structural exemplified embodiment in a side view which corresponds to the action principle according to FIGS. 1 and 2 and which is suitable for the alternative use of one to three contact springs.

Figure 6:
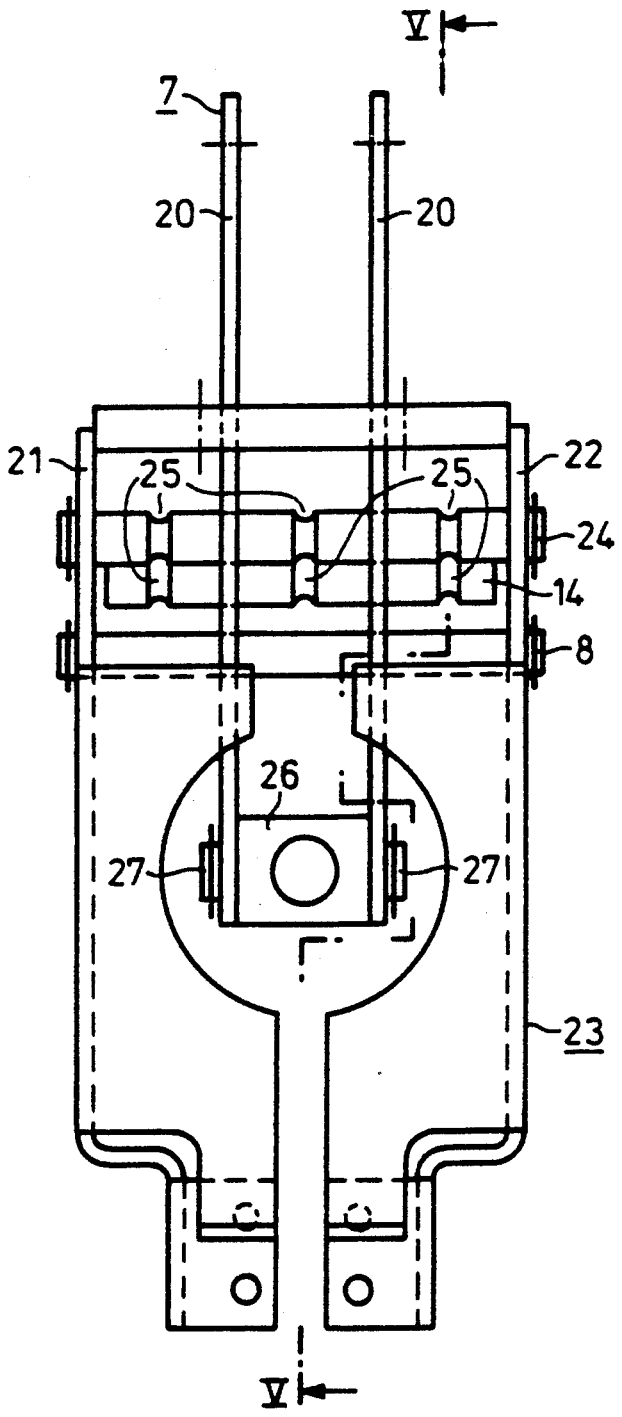

The section VI—VI in FIG. 5 is shown in FIG. 6, however with the vacuum-type interrupters omitted.

DETAILED DESCRIPTION

In FIGS. 1 and 2, the actuating mechanism of a vacuum-type interrupter 1 is represented which has a stationary terminal stud 2 with a stationary contact element 3 as well as a movable actuating impact rod 4 with a movable contact element 5. At the same time, the terminal stud to serves to secure the interrupter 1 in a suitable manner which is not shown more closely. The actuating impact rod 4 is connected on its end by means of a linkage assembly 6 to a two-armed lever 7, at whose opposite end the force serving to switch on the interrupter 1 is introduced. This is indicated in FIG. 2 with an arrow and the designation F. The two-armed lever 7 is able to pivot around a bearing bolt 8 which is able to move within a slotted hole 9 of a bearing block 10. The slotted hole 9 is thereby approximately parallel to the longitudinal axis of the interrupter 1; i.e., aligned parallel to the longitudinal axis of the terminal stud 2 and of the actuating impact rod 4. The propulsive force F also is exerted approximately parallel to the longitudinal axis of the interrupter 1.

The disabled state of the interrupter 1 is shown in FIG. 1. The two-armed lever 7 thereby abuts a stop 12 under the influence of a helical tension spring 11. The tension spring 11 is supported on one end on region 15 of the lever 7 which is provided for the engagement with the force F. In this state, the bearing bolt 8 abuts the end of the slotted hole 9.

If the force F is exerted on the end region 15 of the lever 7 starting from the position of the parts shown in FIG. 1, then the two-armed lever 7 first performs a pivotal movement around its bearing bolt 8, during the course of which the tension spring 11 is stretched and the bearing bolt 8 further maintains the position shown in FIG. 1 on the end of the slotted hole 9. As soon as the contact elements 3 and 5 touch the interrupter 1, the linkage assembly 6 between the two-armed lever 7 and the actuating impact rod 4 becomes the pivotal point of the lever 7. The bearing bolt 8 thereby is disengaged from the end of the slotted hole 9 until, after the corresponding tensioning of the spring 11, the end of the actuating stroke is reached under the influence of the force F. This state is represented in FIG. 2.

As one can see, the tension spring 11 determines both the force keeping the interrupter 1 open within the positioning of the parts according to FIG. 1 as well as the contact force in the position of FIG. 2. These forces can be appropriately selected by means of a suitable choice of lever lengths of the two-armed lever 7 regarding the bearing bolt 8 and by means of the position of the bolt 14 between the end region 15 and the bearing bolt 8.

In the exemplified embodiment according to FIGS. 3 and 4, the two-armed lever 7 is likewise both pivotally positioned and displaceably guided by a bearing bolt 8 within a slotted hole 9. In contrast to exemplified embodiment according to FIGS. 1 and 2, however, the linkage assembly 6 for connecting the two-armed lever 7 and the interrupter 1 is not located at one end of the lever, but rather between the end region 15 and the bearing bolt 8. Furthermore, the tension spring 11 engages with an end region 16 of the lever 7 which lies opposite the end region 15.

In FIG. 3, the interrupter 1 is shown in the disabled state. Consistent with FIG. 1, the two-armed lever 7 thereby assumes a tilted position under the influence of the tension spring 11, whereby the joint pin 8 in the slotted hole 9 represents the pivot bearing.

For enabling, a force F is exerted in return on the end region 15 of the two-armed lever 7, but in the reverse sense of the previous exemplified embodiment. Under the influence of this force, the two-armed lever 7 first performs a rotation around its bearing bolt 8 until the contact elements 3 and 5 touch the interrupter 1 and the linkage assembly 6 acts as a pivot bearing on the impacting rod 4. The tension spring 11 is stretched in order to produce the desired contact force until the end position is reached under the influence of the force F.

FIGS. 5 and 6 show an exemplified embodiment for a lever configuration according to the principle shown in FIGS. 1 and 2. The two-armed lever 7 herewith consists of two bar-type split levers 20 (FIG. 6) which are mounted parallel to each other at a clearance such that the tension spring 11 (FIG. 5) can engage between the split levers 20. The bolt 14 is designed to hang on both sides over the split lever 20 so far that, if needed, additional tension springs can be secured for the engagement of the spring tension with the two-armed lever 7, i.e. the split levers 20. The clearance between the split levers 20 and side walls 21 and 22 of a frame like metal part 23 is accordingly selected for this purpose. A retaining bolt 24 is also supported within these side walls which serves as a stationary abutment of one or several tension springs. Both the bolt 14 as well as the bolt 24 are provided with notch-like recesses 25 which prevent a sideways displacement of the springs. The side walls 21 and 22 of the frame 23 also contain two slotted holes 9 to guide the bearing bolt 8.

As FIG. 5 further shows, the linkage assembly 6 comprises a bearing block 26 with parallel surfaces corresponding to the clearance of the split lever 20. The bearing block 26 is mounted on the end of the actuating impact rod 3. Furthermore, the bearing block 26 bears journals 27 on both sides, over which the split levers 20 grip. A flexible electrical cord 30 connects the actuating impact rod 4 to a stationary connector 31.

The frame 23 is fastened to an insulating bearing plate 32, which can have in common a number of frames corresponding to the pole number of the switching device. For its part, the bearing plate 32 is secured to a grounded base frame 34 by way of post insulators 33. The shown configuration can also be arranged upside down, i.e. with the base frame 34 lying on top e.g., if the switching device is supposed to be installed on the top wall of a receptacle filled with an insulating gas.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An actuating mechanism for switching on and off a vacuum-type interrupter of the type having a stationary contact element and a movable contact element connected with an impacting rod which is linearly displaceable and which carries the movable contact element, comprising:

a lever for accommodating an actuating force which is applied at at least one site for closing the contact elements of the vacuum-type interrupter, said lever further having an abutment to accommodate at least one spring element;

a joint for pivotally connecting the impacting rod to the lever;

a bearing associated with the lever and about which the lever can pivot, said bearing having a bolt, and a guide having an end for accommodating the bearing bolt, said guide allowing movement of the bearing bolt along a line generally parallel to a direction in which the impacting rod is displaceable;

said at least one spring element arranged to connect the lever to a stationary abutment and providing a force for maintaining the contact elements of the interrupter in an open position when no external actuating force is applied to the lever, and which further serves to maintain the bearing bolt in a position in which it abuts the one end of the guide;

whereby depending upon the relative locations along the lever of the bearing bolt, the joint connecting the impact rod to the lever, the abutment to which is attached the spring, and the site of the actuating force, the lever is initially pivotable about the bearing until the contact elements of the vacuum-type interrupter contact each other, after which the lever is pivoted about the joint connecting the lever and the impacting rod against the tension of the spring, so that the spring contributes a contact force between the movable and the stationary contact elements and also stores a force suitable for breaking the contact of the contact elements when the external actuating force is sufficiently reduced.

2. The actuating mechanism recited in claim 1, wherein the lever is comprised of a pair of spaced apart arms in parallel and spatially fixed relation to each other and wherein introduction of the actuating force occurs at one end region of the lever, the joint connecting the lever and the movable impacting rod is located at another end region of the lever, and the spring engaging the lever between the pivot bearing and the actuating end region of the lever.

3. The actuating mechanism recited in claim 1, wherein the spring is engagingly located at the one end region of the lever and the pivot bearing of the lever is located between the location of the spring and the joint connecting the movable impacting rod to the lever.

4. The actuating mechanism recited in claim 1, wherein the lever is comprised of a pair of spaced apart arms in parallel and spatially fixed relation to each other and wherein the resultant two-armed lever is formed from two bars which are mounted parallel to each other, whose separation corresponds at least to the diameter of the spring.

5. The actuating mechanism recited in claim 4, wherein the lever and the spring are positioned or mounted in a stationary, reinforced frame whose side walls are arranged away from the bars of the lever by at least the diameter of the spring.

6. The actuating mechanism according to claim 5, further comprising a first bolt penetrating the lever and a second bolt disposed parallel to the first bolt and supported within the sidewalls of the frame, said second bolt being provided with notches to secure the position of alternatively one, two or three springs.

* * * * *